US006533451B1

(12) United States Patent
Liu

(10) Patent No.: US 6,533,451 B1
(45) Date of Patent: Mar. 18, 2003

(54) UNDERWATER ELECTROMECHANICAL TIMER

(75) Inventor: Ruey-Shan Liu, Kaohsiung (TW)

(73) Assignee: Chung-Shan Institute of Science and Technology, Taoyuan (TW)

( * ) Notice: Subject to any disclaimer, the term of this patent is extended or adjusted under 35 U.S.C. 154(b) by 0 days.

(21) Appl. No.: 10/033,753

(22) Filed: Dec. 19, 2001

(51) Int. Cl.[7] ..... G04F 8/00; G04F 10/00; H01H 7/00

(52) U.S. Cl. ..... 368/101; 368/107; 368/110; 307/141; 307/141.4

(58) Field of Search ..... 368/101–117, 10, 368/327; 307/141, 141.4

(56) References Cited

U.S. PATENT DOCUMENTS 2,991,403 A * 7/1961 Groft ..... 318/266
3,679,951 A * 7/1972 Whitlock ..... 307/141
4,107,546 A * 8/1978 Sturman et al. ..... 307/116
4,766,331 A * 8/1988 Flegel et al. ..... 307/441

* cited by examiner

*Primary Examiner*—David Martin
*Assistant Examiner*—Michael L Lindinger
(74) *Attorney, Agent, or Firm*—J.C. Patents

(57) ABSTRACT

An underwater electromechanical timer comprises a motor-driven timer assembly which includes a threaded member that engages an endless screw driven in rotation by means of a motor. Time programming of the timer is accomplished via presetting a length of sliding of the threaded member along the endless screw. The sliding threaded member causes a timely switching event of a device switch placed in the casing structure. The device switch, electrically connected to an external device, thereby activates the external device. The underwater electromechanical timer is activated via an activation mechanism that is externally exposed. Under an external pressure, the activation mechanism connects an output of the motor with the endless screw, and further turns on the motor. Resilient elements are further mounted between the motor and the endless screw and between the threaded member and the device switch to prevent undesired activation events.

28 Claims, 3 Drawing Sheets

UNDERWATER ELECTROMECHANICAL TIMER

BACKGROUND OF THE INVENTION

1. Field of the Invention

The invention relates generally to timer devices, and more particularly, to an underwater electromechanical timer that can be timely programmed to activate an external device connected to the underwater electromechanical timer.

2. Description of the Related Art

Timer devices are well known to provide delayed activation of various types of devices. Conventionally, the structure and mechanism of timer devices are specifically in accordance with its conditions of use. The following description particularly refers to an example of underwater timer.

In navigation, maritime ships happen to ground between submerged reefs, putting the ships in difficulty. In those situations, explosives are conventionally used to remove the submerged reefs. The explosives are adequately disposed on the site of submerged reefs, and underwater timers are typically connected to the explosives to trigger timely-programmed explosions.

FIG. 1 is a cross-sectional view that depicts a conventional underwater timer known in the art. The conventional underwater timer 10 comprises a casing 15 in which the slide of a control bar 17 enables to timely turn a switch 18. The control bar 17 is tightly mounted with a collar pad 12 that lies on a salt dissolvable supporting block 14 to support and keep the control bar 17 away from the switch 18. To activate the timer 10, the latch 13 that locks the control bar 17 within the casing 15 is first removed. The underwater timer 10 then is put into water. Salt dissolvable supporting block 14 contacting with water then progressively dissolves in water, which causes a progressive slide of the control bar 17 to contact with the switch 18. A rubber membrane 16 is conventionally arranged within the casing 15 to isolate the switch 18 from water contact.

The above conventional timer 10 using a salt element has several deficiencies. The dissolution of the salt element in water is difficult to control with respect to time programming purposes because multiple factors may influence the dissolution velocity. For example, under substantially high water pressure, the salt element may crack into several pieces, which increases the contact area of the salt element with water and consequently accelerates its dissolution in water. The salt element may also easily crack into smaller pieces when the timer is transported. Besides, the waterproof rubber membrane 16 may be damaged due to high water pressure, which restrains the use of the timer to limited water depths. A more reliable, robust, and precise underwater timer is thus needed.

SUMMARY OF THE INVENTION

An aspect of the invention is therefore to provide an underwater electromechanical timer that can be precisely programmed, and provides a precise activation of the devices connected to the timer without being affected by external water pressure.

Another aspect of the invention is to provide an underwater electromechanical timer that can be used in water depth levels higher than the conventional water depth levels.

Yet, another aspect of the invention is to provide an underwater electromechanical timer that is reliable and robust.

To accomplish the above and other objectives, an underwater electromechanical timer of the invention comprises the following elements installed within a casing structure. A motor-driven timer assembly mounted in the casing structure comprises a threaded member that engages an endless screw driven in rotation via a motor. Time programming of the timer is accomplished by presetting a length of sliding of the threaded member along the endless screw. The sliding threaded member causes a timely switching event of a device switch placed within the casing structure. An external device that is electrically connected to the device switch is thereby activated. To activate the timer, an activation mechanism comprised of a plunger is mounted in the casing structure. The activation mechanism is externally exposed. Under adequate external pressure exerted on the activation mechanism, the activation mechanism connects the endless screw with an output of the motor to drive the rotation of the endless screw, and causes a slide of the threaded member. The turn-on and turn-off of the motor are achieved through switches placed in the casing structure. The turn-on of the motor is effectuated by the activation mechanism once the activation mechanism has engaged the endless screw with the output of the motor. The turn-off of the motor is effectuated when the threaded member has reached the end of its sliding course. Resilient controller and protection elements are further mounted between the endless screw and the motor and between the device switch and the threaded member to prevent undesired activation events, thereby improving the reliability and robustness of the timer.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION OF THE PREFERRED EMBODIMENTS

Figure 1:
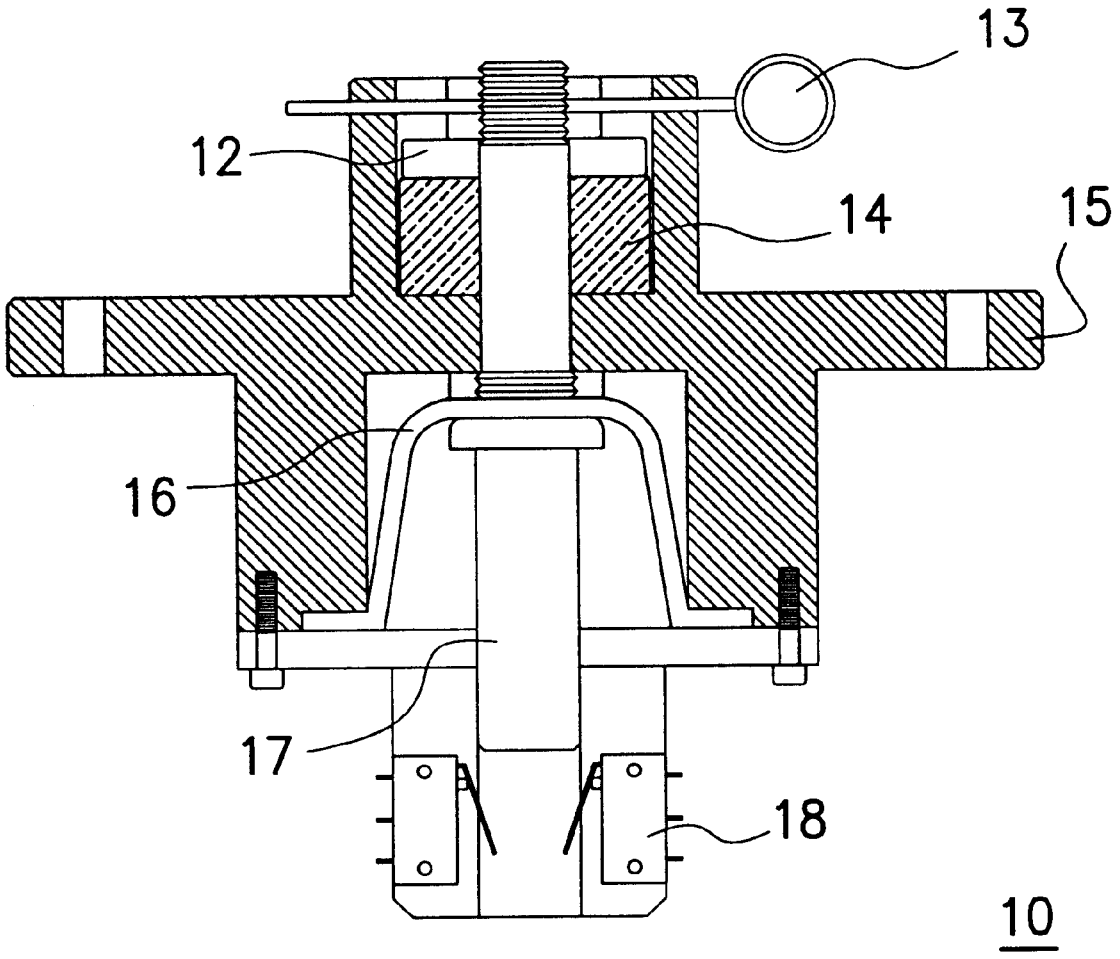
FIG. 1 is a cross-sectional view of a conventional underwater timer.

The following detailed description of the embodiments and examples of the present invention with reference to the accompanying drawings is only illustrative and not limiting. Wherever possible in the following description and accompanying drawings, like reference numerals and symbols will refer to like elements and parts unless otherwise described. In the description, the terms "downwardly", "upwardly", "below", "upper", "central", and "lower" are used in reference to the description drawings.

Figure 2A:
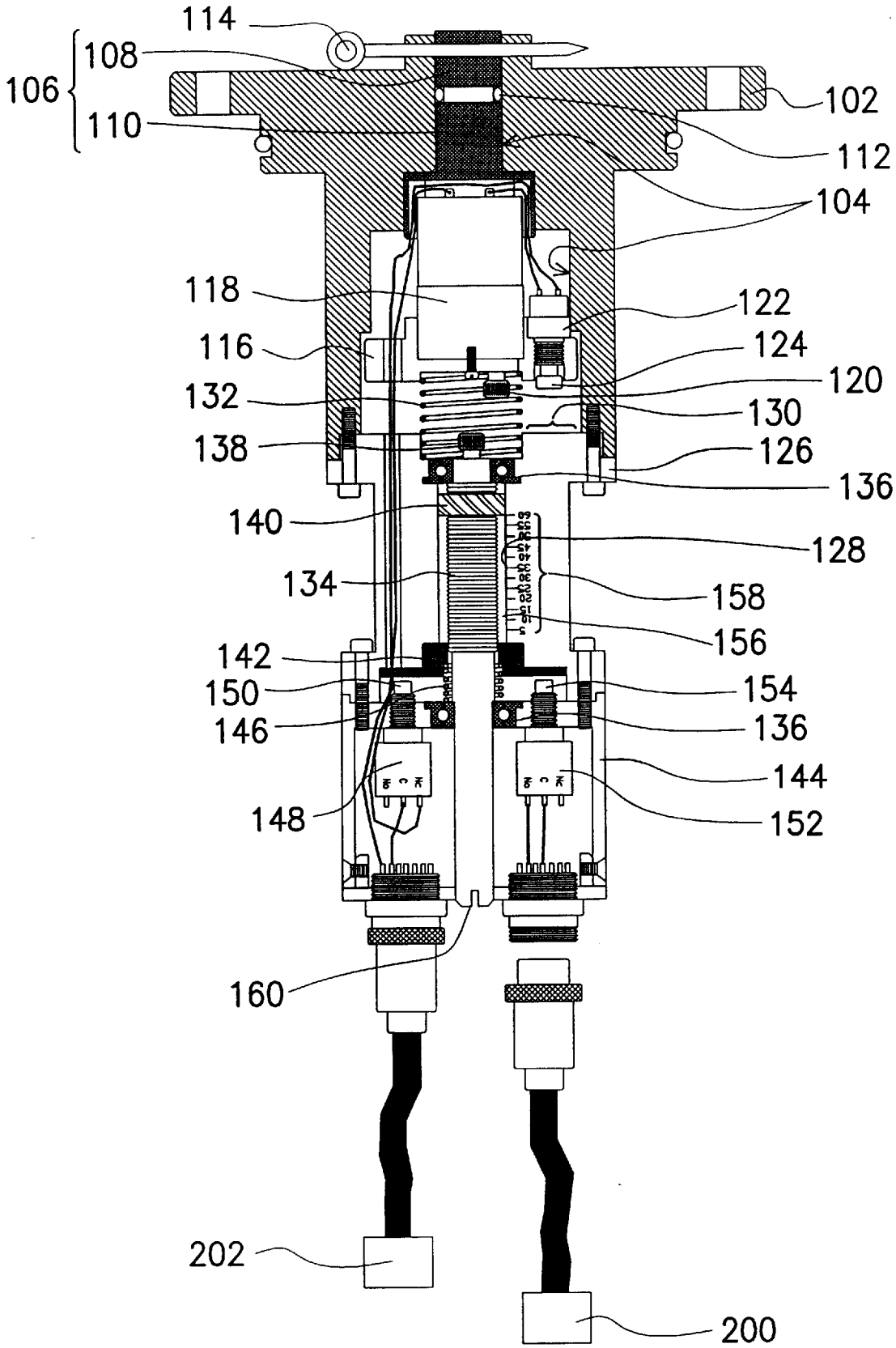
FIG. 2A and FIG. 2B are cross-sectional views illustrating an underwater electromechanical timer according to an embodiment of the invention.

Referring to FIG. 2A, a cross-sectional view schematically illustrates an underwater electromechanical timer according to an embodiment of the invention. FIG. 2 shows a configuration where the timer is not activated. An upper part of an underwater electromechanical timer 100 comprises an upper casing 102 through which is defined a guiding cavity 104 that passes through the upper casing 102. A plunger 106 slidably fits in the guiding cavity 104. The plunger 106 comprises an upper plunger 108 that upwardly terminates into a portion externally exposed, and a lower plunger 110 that terminates within an interior of the upper casing 102. A waterproof joint 112 is disposed between the upper plunger 108 and the lower plunger 110 to prevent water penetration within the casing structure. Hence arranged, the plunger 106 can longitudinally slide along the guiding cavity 104 if a pressure differential is generated between the interior and the exterior of the upper casing 102. A removable latch pin 114 is externally inserted through the upper casing 102 and the plunger 106 at an upper portion of the upper casing 102 to lock the position of the plunger 106 within the guiding cavity 104.

Within the upper casing 102, a carrier guiding block 116 is further mounted below the plunger 106. The carrier guiding block 116 is mounted in a manner to slide downwardly when pushed by the plunger 106. A motor 118 is mounted in the carrier guiding block 116 with a driving wheel 120 of the motor 118 downwardly protruding out of the carrier guiding block 116. The motor 118 further upwardly abuts against the plunger 106. A motor starter switch 122 that is electrically connected to the motor 118 is further mounted to the carrier guiding block 116. The motor starter switch 122 downwardly protrudes out of the carrier guiding block 116 into a switch contact pad 124. In the example of this embodiment, the motor starter switch 122 is exemplary illustrated as a mechanical switch which switching event is caused by mechanical contact.

A central part of the timer 100 further comprises a central casing 126. The central casing 126 may be fixedly and tightly attached to the upper casing 102 via various fastener members such as screw assemblies, for example. A guiding cavity 128 is defined through the central casing 126 while an abutting surface 130 defined within the central casing 126 is remotely vis-a-vis the switch contact pad 124 of the motor starter switch 122. A resilient pressure controller 132, for example a spring, is mounted within the upper casing 102 in a manner to be oppositely connected to the carrier guiding block 116 and the central casing 126.

Within the central casing 126, a mechanical timer assembly comprised of endless screw 134 and threaded member 140 is coaxially mounted through the guiding cavity 128. The endless screw 134 is pivotably mounted through the guiding cavity 128 via a ball bearing 136. The endless screw 134 further upwardly terminates into a transmission wheel 138 that is coaxial with the endless screw 134 and upwardly protrudes out of the central casing 126. The endless screw 134 and the transmission wheel 138 are assembled in a manner to be rotatably dependent on each other, and the transmission wheel 138 is designed in manner to be able to engage and be driven by the driving wheel 120. In addition, the endless screw 134 and the transmission wheel 138 are spaced apart from the driving wheel 120. The distance between the transmission wheel 138 and the abutting surface 130 and the distance between the driving wheel 120 and the switch contact pad 124 are set in a manner to cause a mechanical contact of the abutting surface 130 with the switch contact pad 124 once the driving wheel 120 has engaged the transmission wheel 138. The threaded member 140 has an external profile in compliance with the guiding cavity 128 to longitudinally slide therein when the endless screw 134 rotates. Time programming of the timer 100 is accomplished via presetting a specific length of sliding of the threaded member 140 along the endless screw. The guiding cavity 128 is downwardly closed via a collar 142 through which the endless screw 134 passes.

A lower part of the timer 100 further includes a lower casing 144. The lower casing 144 may be fixedly attached with the central casing 126 via, for example, fastener members such as screw assemblies. It should be noticed that for assembly convenience, the casing structure of the timer 100 is described as being formed of upper, central, and lower casings in the present embodiment. However, those skilled in the art would readily understand that other casing structures may be also adequate without departing from the inventive concepts of the underwater electromechanical timer 100 of the invention.

A resilient protection element 146, for example a spring, is mounted within the lower casing 144 in a manner to be oppositely connected to the collar 142 and the lower casing 144. A motor stop switch 148 that is electrically connected to the motor 118 is disposed within the lower casing 144. The motor stop switch 148 upwardly protrudes into a switch contact pad 150 that is remotely vis-à-vis the collar 142. At least one device switch 152 that is electrically connected to an external device 200 is mounted in the lower casing 144. Similar to the motor stop switch 148, the device switch 152 upwardly protrudes into a switch contact pad 154 that is remotely vis-à-vis the collar 142. In the example of this embodiment, the motor stop switch 148 and the device switch 152 are exemplary mechanical switches which switching event is caused by mechanical contact with their respective switch contact pads 150, 154.

The motor stop switch 148 additionally may be electrically connected to another external device 202. The turn-off of the motor 118 and the activation of the external device 202 can be therefore substantially simultaneous.

A reading display 156 with graduations 158 thereon is further arranged on the central casing 126. The position of the threaded member 140 on the endless screw 134 can be thereby visually controlled. The endless screw 134 downwardly terminates into a rotary element 160. The rotary element 160 is externally exposed through the lower casing 144 so that a user can program the underwater electromechanical timer 100 via turning the rotary element 160 to set the position of the threaded member 140 on the endless screw 134.

Figure 2B:
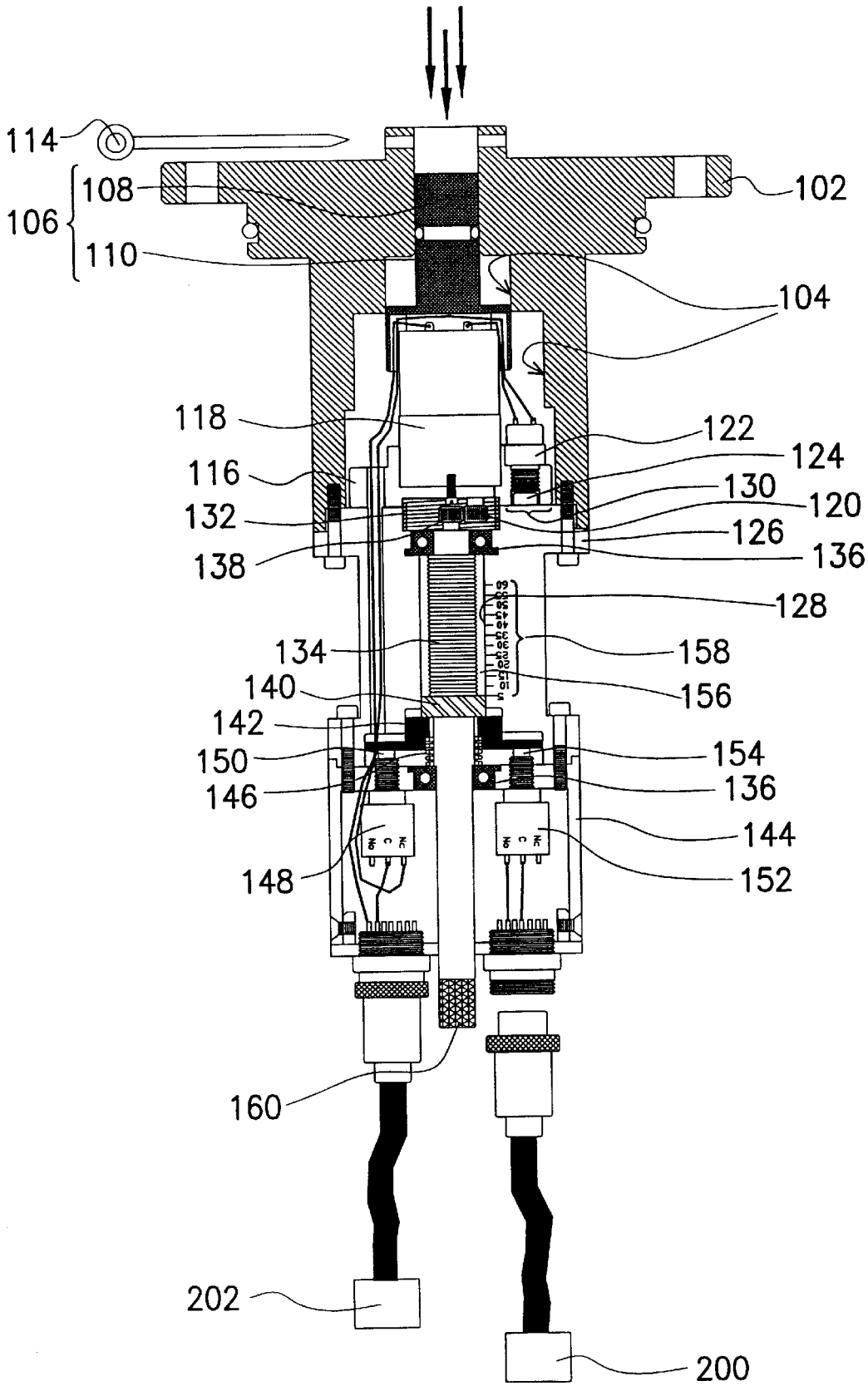

The operation of the above underwater electromechanical timer 100 is now described with the help of FIG. 2A and FIG. 2B. FIG. 2B shows the underwater electromechanical timer 100 in a configuration where time counting is completed.

Through the reading display 156, the user first programs the timer 100 with a desired time interval via turning the rotary element 160, which sets a starting position of the threaded member 140 on the endless screw 134. A programmed time interval may be, for example, 60 minutes. When the timer 100 is at a sufficient water depth, exterior water pressure greater than the interior pressure presses on the plunger 106.

The plunger 106 hence downwardly pushes the motor 118 and the carrier guiding block 116 to engage the driving wheel 120 with the transmission wheel 138 and further put the switch contact pad 124 in mechanical contact with the abutting surface 130, which turns on the motor 118. The plunger 106 and the carrier guiding block 116 hence achieve an activation mechanism of the timer that is directed to activate the mechanical timer assembly.

The driving wheel 120 consequently drives the rotation of the endless screw 134 via the transmission wheel 138, which results in a progressive slide of the threaded member 140 downwardly along the endless screw 134. To adapt the timer 100 with various ranges of time delay, a differential mechanism (not shown) may be further coupled between the driving wheel 120 and the transmission wheel 138.

The sliding threaded member 140 establishes a mechanical contact with the switch contact pads 150, 154 of the motor stop switch 148 and device switch 152 via pushing the collar 142 thereon, thereby timely causing a switching event of the motor switch 148 and the device switch 152. The motor 118 is consequently turned off, which stops the slide of threaded member 142. Damages of the threads of the endless screw 134 and threaded member 142 are thereby prevented. Meanwhile, the device 152 is timely activated. If the motor stop switch 148 is also electrically connected to an external device 202, the device 202 is also activated.

For reliability and robustness consideration, the resilient pressure controller 132 ensures that both carrier guiding block 116 and motor 118 are spaced apart from the mechanical timer assembly when no water pressure is exerted on the plunger 106. Undesired activation of the motor 118 through mechanical contact with the motor starter switch 122 is thereby prevented. Meanwhile, the resilient protection element 146 prevents any contacts of the collar 142 with the switch contact pads 150, 154 that are not caused by a push of the threaded member 140. Undesired activation of the external device 152, 202 is therefore also prevented.

In conclusion, the invention provides an underwater electromechanical timer that is precise, robust, and reliable. Constructed with the motor-driven mechanical timer assembly that can be accurately preset, the timer of the invention provides a timely precise activation of various devices connected to the timer. By including controller and protection elements that prevent undesired activation, the timer of the invention is further reliable and robust. Furthermore, being activated via pressure water, the timer of the invention can be used within a water depth range of about 10 meters to about 1000 meters, the level of 1000 meters can be possibly exceeded. The timer of the invention can be therefore used in a broader range of water depths in comparison with conventional underwater timers that use dissolving salt.

It should be apparent to those skilled in the art that other structures that are obtained from various modifications and variations of various parts of the above-described structures of the invention would be possible without departing from the scope and spirit of the invention as illustrated herein. Therefore, the above description of embodiments and examples only illustrates specific ways of making and performing the invention that, consequently, should cover variations and modifications thereof provided they fall within the inventive concepts as defined in the following claims.

What is claimed is:

1. An underwater electromechanical timer comprising:

a casing structure;

a mechanical timer assembly mounted in the casing structure, the mechanical timer assembly comprising an endless screw and a threaded member engaging the endless screw, wherein a length of sliding of the threaded member along the endless screw represents a time programming of an activation event;

a device switch mounted in the casing structure to activate an external device connected to the device switch, the device switch being switched by mechanical contact;

a plunger element mounted in the casing structure, the plunger element terminating into a first end portion within the casing structure and a second end portion externally exposed through the casing structure so that the plunger element slides within the casing structure when a difference of pressure between an interior and an exterior of the casing structure occurs; and a motor slidably mounted in the casing structure and abutting the plunger element, the motor being connected to a driving wheel, thereby the plunger element under a greater external pressure engages the driving wheel of the motor with the mechanical timer assembly to rotate the endless screw so that the threaded member progressively slides along the endless screw to establish a timely-programmed mechanical contact of the device switch to activate the external device.

2. The timer of claim 1, wherein the mechanical timer assembly includes a transmission wheel that connects the endless screw to engage the driving wheel.

3. The timer of claim 1, wherein the motor is mounted onto a carrier guiding block slidably mounted in the casing structure.

4. The timer of claim 3, further including a resilient element that is oppositely mounted between the carrier guiding block and the mechanical timer assembly.

5. The timer of claim 3, wherein the motor is connected to a motor starter switch that is mounted on the carrier guiding block to activate the rotation of the motor once the driving wheel has engaged with the mechanical timer assembly, the motor starter switch being turned via mechanical contact.

6. The timer of claim 1, wherein the endless screw further passes through a collar slidably disposed between the threaded member and the device switch so that the threaded member pushes the collar onto the device switch to turn the external device.

7. The timer of claim 1, wherein the sliding threaded member further timely establishes a mechanical contact with a motor stop switch that is electrically connected to the motor, the motor stop switch thereby turning off the motor.

8. The timer of claim 7, wherein the motor stop switch and the device switch are simultaneously turned via a timely-programmed mechanical contact established by the sliding threaded member.

9. The timer of claim 7, wherein the motor stop switch is further connected to an additional external device.

10. The timer of claim 6, further including a resilient element that is oppositely mounted between the collar and the device switch.

11. The timer of claim 1, further including a reading display on the casing structure that enables a user to visually control the position of the threaded member on the endless screw.

12. The timer of claim 1, further including a rotary element that is internally connected to the endless screw and externally exposed to enable a user to program the timer by presetting the position of the threaded member on the endless screw.

13. The timer of claim 1, wherein the plunger element is locked within the casing structure by means of a removable latch pin externally inserted through the casing structure and the plunger element.

14. The timer of claim 1, further comprising a waterproof joint mounted on the plunger element to prevent water penetration.

15. The timer of claim 1 being adequate within a water depth range of about 10 meters to about 1000 meters.

16. An underwater electromechanical timer comprising:

a casing structure;

a device switch mounted in the casing structure to activate an external device connected to the device switch;

a motor-driven timer assembly mounted in the casing structure, the motor-driven timer assembly comprising a threaded member that engages an endless screw driven in rotation by means of a motor, wherein a length of sliding of the threaded member along the endless screw timely programs a switching event of the device switch; and an activation mechanism activating the motor-driven timer assembly by connecting an output of the motor with the endless screw to drive a rotation of the endless screw, the activation mechanism being triggered via an external pressure applied thereon.

17. The timer of claim 16, wherein the motor drives the endless screw in rotation by means of a driving wheel connected to the motor that engages a transmission wheel connected to the endless screw.

18. The timer of claim 17, wherein the activation mechanism activates the motor-driven timer assembly by engaging the driving wheel with the transmission wheel.

19. The timer of claim 18, wherein the activation mechanism further activates a rotation of the motor by causing a switching event of a motor starter switch once the driving wheel has engaged the transmission wheel.

20. The timer of claim 16, wherein the sliding threaded member timely causes a switching event of the device switch via establishing a mechanical contact with the device switch.

21. The timer of claim 16, wherein the sliding threaded member further timely causes a switching event of a motor stop switch mounted in the casing structure to turn off the motor.

22. The timer of claim 21, wherein the switching event of the motor stop switch is substantially simultaneous to the switching event of the device switch.

23. The timer of claim 21, wherein the motor stop switch is further electrically connected to an additional external device.

24. The timer of claim 16, further comprising a reading display on the casing structure that enables a user to visually control the position of the threaded member on the endless screw.

25. The timer of claim 16, further comprising a rotary element that is internally connected to the endless screw and externally exposed through the casing structure to enable a user to program the timer by manually presetting the position of the threaded member on the endless screw.

26. The timer of claim 16, further comprising a removable latch member that locks the activation mechanism.

27. The timer of claim 16, further comprising a plurality of resilient elements disposed respectively between the endless screw and the trigger mechanism and between the threaded member and the device switch in order to prevent undesired activation events.

28. The timer of claim 16 being adequate within a depth range of about 10 meters to about 1000 meters.

* * * * *